US009951497B2

(12) United States Patent
Ge et al.

(10) Patent No.: US 9,951,497 B2
(45) Date of Patent: Apr. 24, 2018

(54) HYBRID POWER TRAIN SYSTEM FOR A TRACTOR SCRAPER

(71) Applicant: Caterpillar Inc., Peoria, IL (US)

(72) Inventors: Xinyu Ge, Peoria, IL (US); Baojun Si, Dunlap, IL (US); Yingying Kuai, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 179 days.

(21) Appl. No.: 15/137,916

(22) Filed: Apr. 25, 2016

(65) Prior Publication Data

US 2017/0306589 A1 Oct. 26, 2017

(51) Int. Cl.

| | |
|---|---|
| ***B60K 5/00*** | (2006.01) |
| ***E02F 9/20*** | (2006.01) |
| ***E02F 3/64*** | (2006.01) |
| ***E02F 3/65*** | (2006.01) |

(52) U.S. Cl.

CPC ..... *E02F 9/2062* (2013.01); *E02F 3/6409* (2013.01); *E02F 3/652* (2013.01); *E02F 9/2091* (2013.01); *E02F 9/2095* (2013.01)

(58) Field of Classification Search

CPC ..... E02F 9/2062; E02F 9/206; E02F 9/2095; E02F 9/20652; B60K 5/00

See application file for complete search history.

(56) References Cited

U.S. PATENT DOCUMENTS

| | | | | |
|---|---|---|---|---|
| 4,207,691 | A | 6/1980 | Hyler et al. | |
| 6,205,379 | B1 | 3/2001 | Morisawa et al. | |
| 8,229,631 | B2 | 7/2012 | Morey et al. | |
| 8,362,629 | B2 * | 1/2013 | Weber | F04B 1/04 187/224 |
| 9,062,616 | B2 | 6/2015 | Zhang et al. | |
| 2014/0175773 | A1 | 6/2014 | Ault et al. | |

* cited by examiner

*Primary Examiner* — John D Walters
*Assistant Examiner* — James J Triggs
(74) *Attorney, Agent, or Firm* — Miller, Matthias & Hull

(57) ABSTRACT

A hybrid power train system for a tractor scraper is provided. The hybrid power train system may include a primary power source coupled to a first set of traction devices, a generator coupled to the primary power source, a first electric motor coupled to a second set of traction devices, an inverter circuit coupled to the generator and the first electric motor, an energy storage device coupled to the inverter circuit, and a controller operatively coupled to the inverter circuit. The controller may be configured to engage a first operation mode enabling electrical energy, supplied by the generator and the first electric motor, to be stored in the energy storage device, and engage a second operation mode enabling electrical energy, stored in the energy storage device, to be supplied to the first electric motor to drive the second set of traction devices.

20 Claims, 4 Drawing Sheets

HYBRID POWER TRAIN SYSTEM FOR A TRACTOR SCRAPER

TECHNICAL FIELD

The present disclosure relates generally to hybrid power train systems, and more particularly, to systems and methods for implementing and operating a hybrid power train system on a tractor scraper.

BACKGROUND

A variety of different earthmoving machines may be employed to move earth, rocks, and other materials from an excavation site. Often, it may be desirable to transport excavated material for a distance (e.g., haul distance) from an excavation site to another location (e.g., dump site) remote from the excavation site. Depending on the haul distance between the excavation site and the dump site, different types of earthmoving machines or techniques may be preferred over others. For longer haul distances (e.g., longer than a threshold haul distance), an off-highway haulage unit may be used to load earth, rocks, and other materials, and transport the loaded materials to the dump site. For shorter haul distances (e.g., shorter than a threshold haul distance), a tractor scraper may be used for excavating, hauling and dumping the excavated material.

Tractor scrapers may be preferred over other earthmoving machines for a number of reasons. In particular, tractor scrapers are versatile and may be employed in various industries, such as in agricultural, construction, mining, and other industries. Additionally, for relatively shorter haul distances, such as haul distances of approximately one mile or less, the design of tractor scrapers as well as the control schemes for tractor scrapers help to reduce operating costs, minimize operator skill and time, and improve overall efficiency and productivity. For instance, tractor scrapers may operate in substantially reiterative work cycles, where each work cycle may include cutting material from one location during a load segment, transporting the cut material to another location during a haul segment, unloading the cut material during a dump segment, and returning to an excavation site during a return segment to repeat the work cycle.

A conventional tractor scraper typically includes a tractor, a scraper attached to the rear of the tractor via an articulated joint. The tractor may support an operator cabin, a set of tractor wheels, and a combustion engine for driving the tractor wheels. The scraper may support a set of trailing scraper wheels, a bowl system and one or more work tools, such as elevators, conveyors, augers, spades, or the like, to aid in the loading or unloading of material. Once at the excavation site, the bowl system is lowered as the tractor scraper travels forward to cut or collect material from the ground. Once loaded, the bowl system is raised to provide sufficient clearance while hauling the loaded material to the dump site. At the dump site, the bowl system is lowered to dump the loaded material. Once fully unloaded, the bowl system is then raised again to provide the necessary clearance while traveling back to the excavation site.

Among other things, there is an ongoing interest to improve the overall performance and efficiency of tractor scrapers. For instance, one proposed improvement involves adding a separate engine to the rear scraper to help drive the rear wheels and to further enhance the productivity and flexibility of the tractor scraper. However, this configuration requires a rear transmission with speed ratios that typically differ from those of the front transmission, which further requires inefficient converter drives to ensure that rear wheel speeds match front wheel speeds. Operating a tractor scraper with two engines is also complicated by the need to operate two separate throttle pedals, one for each engine. Furthermore, conventional dual-engine tractor scrapers consume more fuel, without providing any adequate means for recovering and/or regenerating the energy expended.

One solution for overcoming the need for two engines while providing access to regenerative energy is to implement a power-split system. A power-split system can mechanically split the power output by a single engine to drive electric motors capable of both motoring and generating modes of operation. However, the application of power-split systems on tractor scrapers are precluded by the articulated nature of the joint between the front tractor and the rear scraper, and the typical levels of physical stress that are exerted on the articulated joint during normal operation. Implementing rigid structures to split or transfer the mechanical power output by the engine at the front of the tractor scraper to the rear wheels at the scraper over an articulated joint would not be cost-effective or feasible. Hydraulic-based regenerative solutions are also not feasible due to similar challenges associated with extending large diameter hydraulic piping across the articulated joint.

Yet another solution for improving the performance and efficiency of tractor scrapers without relying on dual-engines may be to employ electrical means of transferring power between the front tractor and the rear scraper. One such solution is disclosed in U.S. Pat. No. 4,207,691 ("Hyler"). In Hyler, an engine is provided in the rear scraper which drives the rear wheels and a generator. The electrical energy supplied by the generator is then applied to an electric motor in the front tractor to drive the front wheels. Similar to the dual-engine configuration, however, the configuration in Hyler still relies on a torque converter, a transfer shaft, and a transmission to adjust the speeds between the driven wheels. Furthermore, like in other conventional tractor scrapers, Hyler does not provide any means for recapturing or regenerating expended energy.

In view of the foregoing disadvantages associated with conventional tractor scrapers, a need therefore exists for more efficient, cost-effective solutions that not only facilitate operator control, but also improve overall performance thereof. Accordingly, the present disclosure is directed at addressing one or more of the deficiencies and disadvantages set forth above. However, it should be appreciated that the solution, provided by the present disclosure, of any particular problem is not a limitation on the scope of the present disclosure or of the attached claims except to the extent expressly noted.

SUMMARY OF THE DISCLOSURE

In one aspect of the present disclosure, a hybrid power train system for a tractor scraper is provided. The hybrid power train system may include a primary power source coupled to a first set of traction devices of the tractor scraper, a generator coupled to the primary power source, a first electric motor coupled to a second set of traction devices of the tractor scraper, an inverter circuit coupled to the generator and the first electric motor, an energy storage device coupled to the inverter circuit, and a controller operatively coupled to the inverter circuit. The controller may be configured to engage a first operation mode for enabling electrical energy, supplied by the generator and the first electric motor, to be stored in the energy storage device, and engage a second operation mode for enabling electrical energy, stored in the energy storage device, to be supplied to the first electric motor to drive the second set of traction devices.

In another aspect of the present disclosure, a method of operating a hybrid power train system of a tractor scraper is provided. The method may include determining cycle characteristics of a work cycle of the tractor scraper, identifying an operation mode of the tractor scraper based on the cycle characteristics and the work cycle, storing electrical energy, generated through a primary power source and rear traction devices of the tractor scraper, into an energy storage device when a first operation mode for the hybrid power train system is identified, and supplying electrical energy, stored in the energy storage device, to the rear traction devices of the tractor scraper when a second operation mode for the hybrid power train system is identified.

In yet another aspect of the present disclosure, a tractor scraper is provided. The tractor scraper may include a tractor, a scraper coupled to the tractor by an articulated joint, and a controller. The tractor may include a primary power source, a generator, front traction devices, and a continuously variable transmission coupling the primary power source to the generator and the front traction devices. The scraper may include rear traction devices, a bowl system, a first electric motor coupled to the rear traction devices, a second electric motor coupled to the bowl system, an inverter circuit coupled to the generator, the first electric motor and the second electric motor, and an energy storage device coupled to the inverter circuit. The controller may be operatively coupled to the inverter circuit and configured to engage a first operation mode for enabling electrical energy, supplied by the generator and the first electric motor, to be stored in the energy storage device, engage a second operation mode for enabling electrical energy, stored in the energy storage device, to be supplied to the first electric motor to drive the rear traction devices, engage a third operation mode for enabling electrical energy, stored in the energy storage device, to be supplied to the second electric motor and lowering the bowl system, and engage a fourth operation mode for enabling electrical energy, stored in the energy storage device, to be supplied to the second electric motor and raising the bowl system.

These and other aspects and features will be more readily understood when reading the following detailed description in conjunction with the accompanying drawings.

While the following detailed description is given with respect to certain illustrative embodiments, it is to be understood that such embodiments are not to be construed as limiting, but rather the present disclosure is entitled to a scope of protection consistent with all embodiments, modifications, alternative constructions, and equivalents thereto.

DETAILED DESCRIPTION

Figure 1:
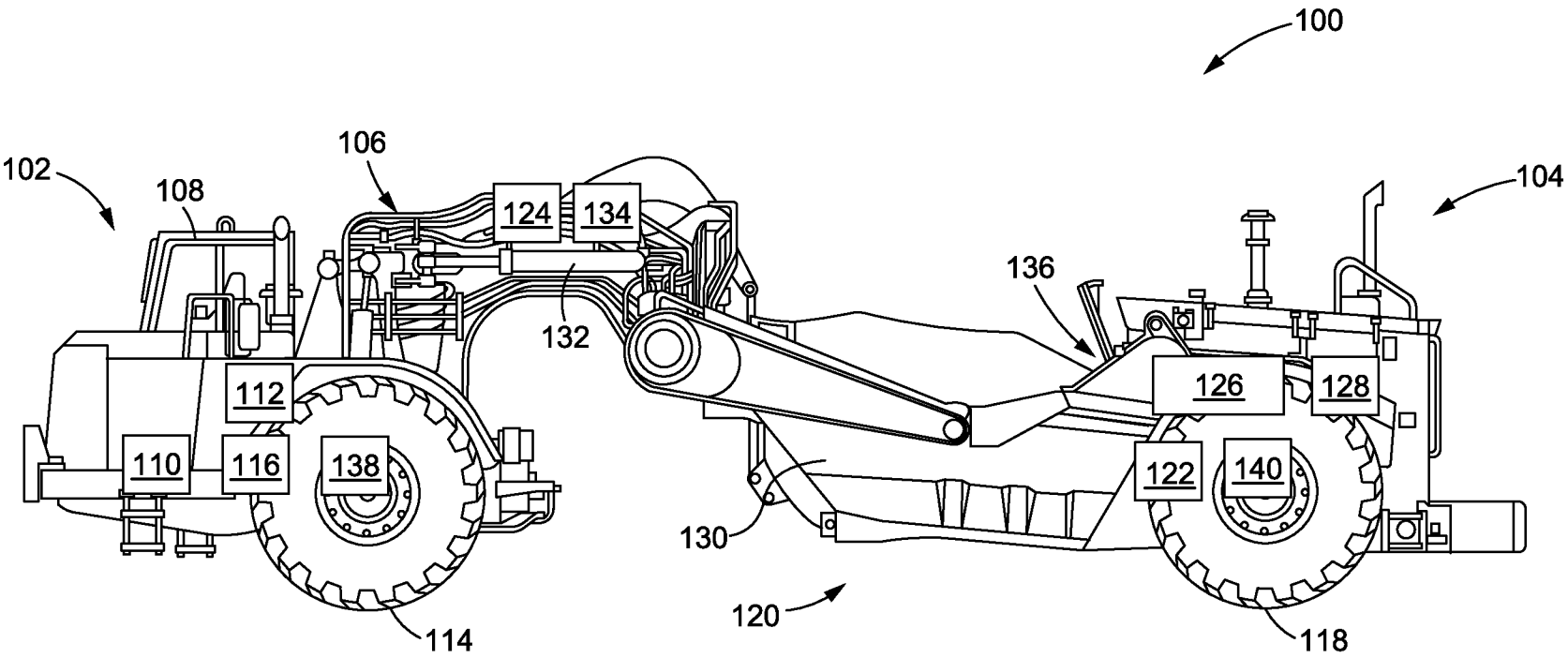
FIG. 1 is a diagrammatic illustration of one exemplary embodiment of a tractor scraper constructed in accordance with the teachings of the present disclosure.

Referring now to FIG. 1, one exemplary embodiment of a work machine 100, such as a tractor scraper, is diagrammatically provided. As shown, the tractor scraper 100 generally includes a tractor 102 disposed at the front of the tractor scraper 100, and a scraper 104 that is pivotally coupled to the tractor 102 via an articulated joint 106. More specifically, the tractor 102 of FIG. 1 includes an operator cab 108, a primary power source 110, a generator 112, a first set of traction devices (such as front traction devices 114), and a transmission 116 coupling the primary power source 110 to the generator 112 and the front traction devices 114. The scraper 104 of FIG. 1 includes a second set of traction devices, (such as rear traction devices 118), a bowl system 120, a first electric motor 122 coupled to the rear traction devices 118, a second electric motor 124 coupled to the bowl system 120. The scraper 104 also includes an inverter circuit 126 coupled to the generator 112, the first electric motor 122 and the second electric motor 124, as well as an energy storage device 128 coupled to the inverter circuit 126.

Still referring to FIG. 1, the primary power source 110 may include a combustion engine, such as a diesel engine, a gasoline engine, a natural gas engine, and/or any other suitable power source capable of mechanically driving the transmission 116. Furthermore, the primary power source 110 of FIG. 1 may be configured to operate at any one of a plurality of discrete operating speeds. In the primary power source 110 that is provided in the form of a combustion engine, for example, may be configured to operate at discrete operating speeds of approximately 1200 revolutions per minute (RPM), 1400 RPM, 1600 RPM, 1800 RPM, and/or other discrete operating speeds that have been predetermined as being fuel-efficient. The transmission 116 may include a continuously variable transmission (CVT), an electronically controlled continuously variable transmission (ECVT), and/or any other planetary gear set capable of mechanically coupling the output of the primary power source 110 to each of the generator 112 and the front traction devices 114. Moreover, the transmission 116 may be configured to receive and continuously convert the discrete operating speeds of the primary power source 110 into appropriate drive speeds for operating each of the generator 112 and the front traction devices 114.

As shown in FIG. 1, the bowl system 120 further includes a bowl assembly 130, at least one bowl actuator 132, a kinetic flywheel system 134, and one or more work tools 136, such as elevators, conveyors, augers, spades, and/or the like, for assisting the loading and unloading tasks of the bowl system 120. Furthermore, each of the first electric motor 122 and the second electric motor 124 includes an electric machine capable of converting alternating current (AC) voltage input into mechanical or rotational output, and/or converting mechanical or rotational input into AC voltage, depending on the switching pattern employed by the associated inverter circuit 126. For example, the inverter circuit 126 converts direct current (DC) voltage from the energy storage device 128 into AC voltage suited to drive the first electric motor 122 and the rear traction devices 118. Similarly, the inverter circuit 126 converts DC voltage from the energy storage device 128 into AC voltage suited to drive the second electric motor 124 and the bowl actuator 132 to operate the bowl assembly 130 and/or the one or more work tools 136 thereof.

The energy storage device 128 of FIG. 1 may include one or more batteries, supercapacitors, ultracapacitors, and/or any other device suited to at least temporarily store and supply electrical energy. In addition, each of the front traction devices 114 and the rear traction devices 118 may include one or more wheels, tracks and/or any other suitable device capable of moving the tractor scraper 100. Furthermore, the front traction devices 114 and the rear traction devices 118 may be independently driven. As shown in FIG. 1, for example, the front traction devices 114 are driven by the transmission 116 through a first set of transfer gears 138, such as front transfer gears, while the rear traction devices 118 are driven by the first electric motor 122 through a second set of transfer gears 140, or in this case rear transfer gears. Although the embodiment of FIG. 1 presents one possible configuration for a tractor scraper 100, other configurations are possible and will be apparent to those of ordinary skill in the art.

Figure 2:
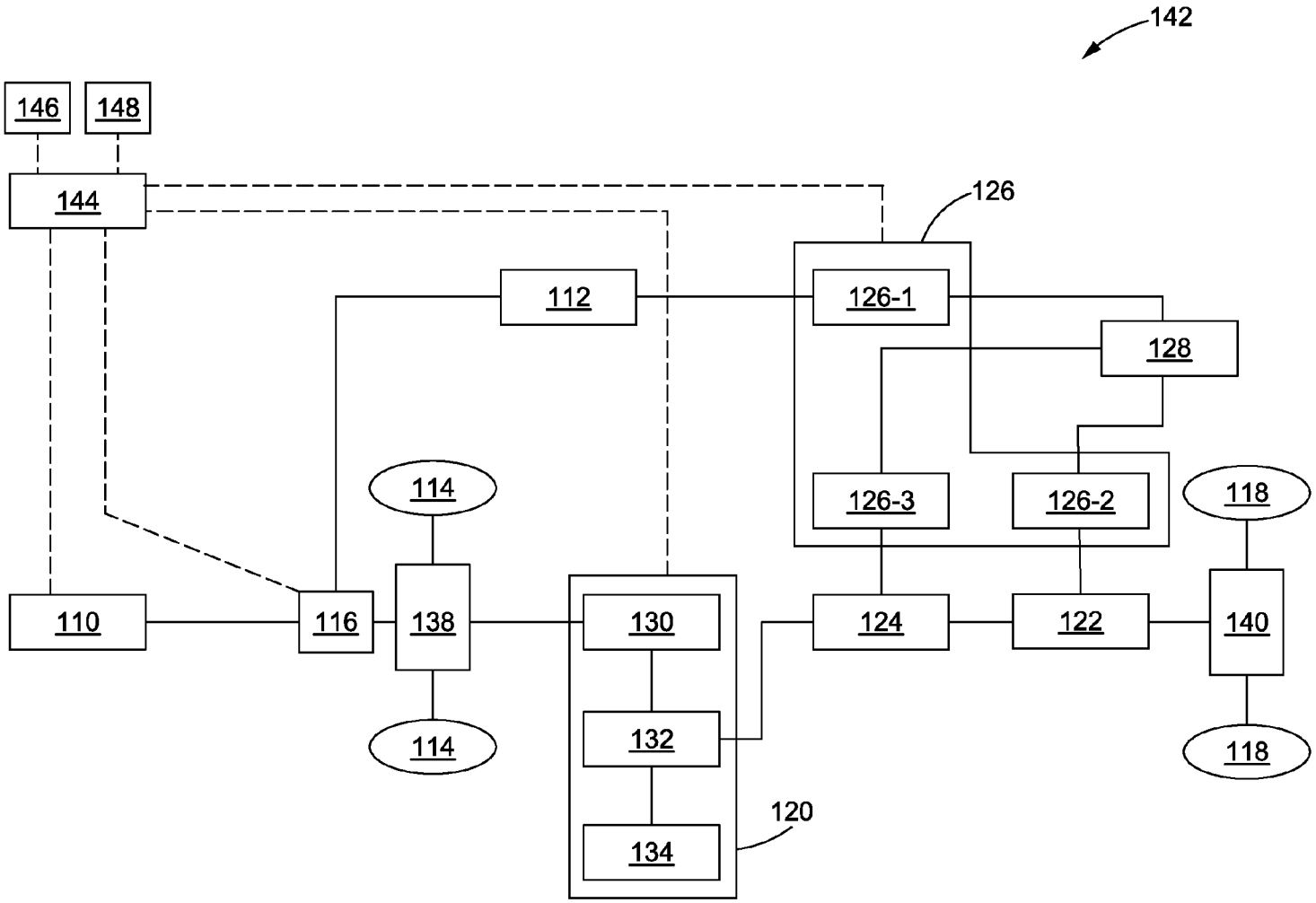
FIG. 2 is a schematic illustration of one exemplary embodiment of a hybrid power train system for a tractor scraper constructed in accordance with the teachings of the present disclosure.

Turning to FIG. 2, one exemplary embodiment of a hybrid power train system 142 for a tractor scraper 100 is provided. As discussed with respect to the tractor scraper 100 of FIG. 1, the hybrid power train system 142 of FIG. 2 may include a primary power source 110 coupled to the front traction devices 114 of the tractor scraper 100, a generator 112 coupled to the primary power source 110, a first electric motor 122 coupled to the rear traction devices 118 of the tractor scraper 100, an inverter circuit 126 coupled to the generator 112 and the first electric motor 122, and an energy storage device 128 coupled to the inverter circuit 126. As shown, the hybrid power train system 142 may additionally include a second electric motor 124 that is coupled to the bowl system 120 of the tractor scraper 100. The inverter circuit 126 may additionally couple the second electric motor 124 to the energy storage device 128. The second electric motor 124 in FIG. 2, for example, is operatively coupled to the bowl system 120 via the bowl actuator 132. Using the bowl actuator 132, the second electric motor 124 can raise the bowl assembly 130, lower the bowl assembly 130, and/or perform other tasks related to the bowl system 120.

Furthermore, while the inverter circuit 126 of FIG. 2 may be configured in any other suitable arrangement, the particular inverter circuit 126, shown, includes a first inverter 126-1 electrically coupling the generator 112 to the energy storage device 128, a second inverter 126-2 electrically coupling the first electric motor 122 to the energy storage device 128, and a third inverter 126-3 electrically coupling the second electric motor 124 to the energy storage device 128. As shown, the hybrid power train system 142 may additionally include an ECVT 116 coupling the primary power source 110 to each of the generator 112 and the front traction devices 114. Still further, the hybrid power train system 142 may also include or incorporate front transfer gears 138 for mechanically coupling the ECVT 116 to the front traction devices 114 of the tractor scraper 100, and further include rear transfer gears 140 for mechanically coupling the first electric motor 122 to the rear traction devices 118 of the tractor scraper 100.

In addition, the hybrid power train system 142 of FIG. 2 also includes a controller 144 that is configured to manage the operation of, and the flow of power within, the hybrid power train system 142. As shown, the controller 144 is operatively coupled to at least the inverter circuit 126, but may additionally be coupled to one or more of the primary power source 110, the transmission or ECVT 116, the bowl system 120, sensor devices 146, operator input devices 148, and/or the like. The controller 144 may be incorporated within an engine control module (ECM), an engine control unit (ECU), a transmission control module (TCM), or a transmission control unit (TCU) of the tractor scraper 100, or otherwise implemented using one or more of a processor, a microprocessor, a microcontroller, a digital signal processor (DSP), a field-programmable gate array (FPGA), and/or the like. Moreover, the controller 144 may be configured to operate the hybrid power train system 142 according to predetermined algorithms or sets of instructions capable of selectively engaging between a plurality of different operation modes, each of which improve efficiency and performance of the tractor scraper 100 for the particular task at hand.

Figure 3:
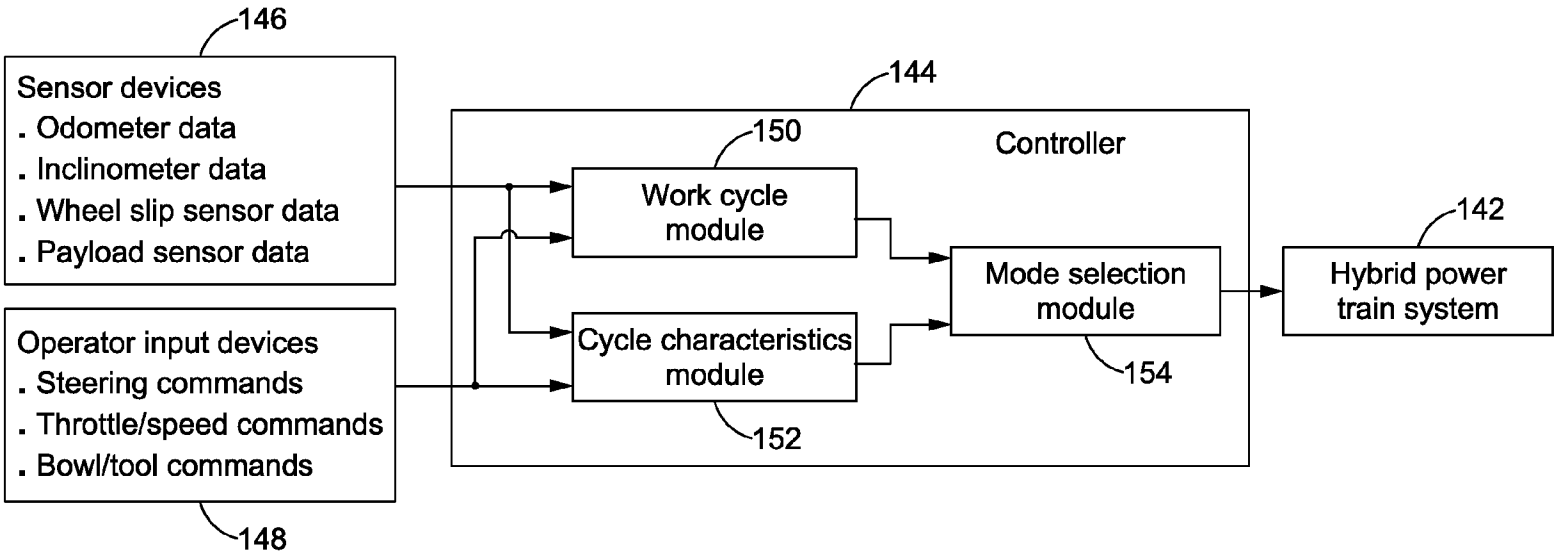
FIG. 3 is a diagrammatic illustration of one exemplary controller of the present disclosure.

Referring to FIG. 3, one exemplary embodiment of the controller 144 of the hybrid power train system 142 is diagrammatically provided. As shown, the controller 144 electronically interfaces between one or more sensor devices 146 of the tractor scraper 100, one or more operator input devices 148 of the tractor scraper 100, and the hybrid power train system 142. The one or more sensor devices 146 may include devices that are disposed on the tractor scraper 100 and configured to detect, measure and/or derive odometer data, inclinometer data, wheel slip sensor data, payload sensor data, and/or any other information relevant to the operation of the tractor scraper 100. The one or more operator input devices 148 may include any combination of instruments or controls disposed locally within the operator cab 108 and/or remotely situated that can be used by an operator to input steering commands, throttle or speed commands, bowl commands, work tool commands, and/or the like.

As shown in FIG. 3, the controller 144 includes a work cycle module 150 configured to determine the work cycle of the tractor scraper 100 based on the data and input supplied by the one or more sensor devices 146 and the one or more operator input devices 148. For a tractor scraper 100, the work cycle may reiteratively cycle between one or more of a load segment, a haul segment, a dump segment, a return segment, and/or the like. For example, each work cycle may include cutting material from an excavation site during the load segment, transporting the cut material to a dump site during the haul segment, unloading the cut material during the dump segment, and returning to the excavation site during the return segment. The controller 144 of FIG. 3 further includes a cycle characteristics module 152 configured to determine certain characteristics of the work cycle, such as the length of the haul or return segment, a grade of the haul or return segment, a load growth curve of the load segment, the length or number of inclines and/or declines in either of the haul or return segment, and/or the like.

The controller 144 of FIG. 3 further includes a mode selection module 154 configured to determine an efficient mode of operating the hybrid power train system 142 based on the work cycle and the cycle characteristics. By default, the controller 144 may be configured to operate the primary power source 110 at discrete operating speeds, while operating the ECVT 116 to drive the front traction devices 114 according to target ground speeds. Target ground speeds may refer to the overall speed of the tractor scraper 100 relative to the ground or work surface and/or any derivative thereof that is specified by an operator of the tractor scraper 100 using the operator input devices 148. For example, the primary power source 110 is operated or idled at speeds that have been predetermined as being both fuel efficient while also sufficient for powering the hybrid power train system 142 for given loads. The controller 144 is also configured to selectively control the inverter circuit 126 between at least two operation modes, such as a first operation mode for regenerating and/or generating energy and a second operation mode for motoring or powering the rear traction devices 118.

In some implementations, one or more of the work cycle module 150, the cycle characteristics module 152, or the mode selection module 154 may include hardware, software, or combinations thereof, to perform a respective task. For example, one or more of the work cycle module 150, the cycle characteristics module 152, or the mode selection module 154 may include a set of instructions configured to use hardware, software, or combinations thereof, to perform a respective task.

More specifically, in the first operation mode, the controller 144 of FIGS. 2 and 3 engages the inverter circuit 126 such that electrical energy, such as electrical energy at least partially supplied by each of the generator 112 and the first electric motor 122, can be stored in the energy storage device 128. For example, the controller 144 may selectively enable switches or transistors within the inverter circuit 126 in a manner which converts AC voltage output by each of the generator 112 and the first electric motor 122 into DC voltage suited for the energy storage device 128. The first operation mode may be suitable for work cycles, such as haul and return segments, having declines or descending paths, or where it is possible to use regenerative braking to recapture energy. In the second operation mode, the controller 144 engages the inverter circuit 126 such that electrical energy stored in the energy storage device 128 can be supplied to at least the first electric motor 122 to drive the rear traction devices 118. In some implementations, electrical energy that is supplied by the energy storage device 128 to the first electric motor 122 may at least partially include electrical energy previously supplied by the generator 112 and/or the first electric motor 122. In some implementations, electrical energy previously stored within the energy storage device 128 may not necessarily include electrical energy previously supplied by the generator 112 and/or the first electric motor 122. The second operation mode may be well suited for work cycles, such as haul and return segments, having ascending paths and/or rough terrain, where it would be beneficial to drive the rear traction devices 118 and assist the front traction devices 114.

The controller 144 of FIGS. 2 and 3 may further be configured to selectively switch between operation modes for controlling the bowl system 120, such as a third operation mode for lowering the bowl assembly 130 and a fourth operation mode for raising the bowl assembly 130. In the third operation mode, the controller 144 engages the inverter circuit 126 such that electrical energy stored in the energy storage device 128 is supplied to the second electric motor 124, and such that the second electric motor 124 drives the bowl actuator 132 to lower the bowl assembly 130. For example, the controller 144 may selectively enable switches or transistors within the inverter circuit 126 in a manner which converts DC voltage output by the energy storage device 128 into AC voltage configured to operate the second electric motor 124, and in turn, operate the bowl actuator 132 to lower the bowl assembly 130. In some implementations, electrical energy that is supplied by the energy storage device 128 to the second electric motor 124 may at least partially include electrical energy previously supplied by the generator 112 and/or the first electric motor 122. In some implementations, electrical energy previously stored within the energy storage device 128 may not necessarily include electrical energy previously supplied by the generator 112 and/or the first electric motor 122. The third operation mode is suitable for the dump segment, immediately before the load segment, or any other instance during which the bowl assembly 130 should be lowered.

In the fourth operation mode, the controller 144 similarly engages the inverter circuit 126 such that electrical energy stored in the energy storage device 128 is supplied to the second electric motor 124, and such that the second electric motor 124 drives the bowl actuator 132 to raise the bowl assembly 130. For example, the controller 144 may selectively enable switches or transistors within the inverter circuit 126 in a manner which converts DC voltage output by the energy storage device 128 into AC voltage configured to operate the second electric motor 124, and in turn, operate the bowl actuator 132 to raise the bowl assembly 130. Additionally, electrical energy that is supplied by the energy storage device 128 to the second electric motor 124 may at least partially include electrical energy previously supplied by the generator 112 and/or the first electric motor 122. However, it will be understood that electrical energy previously stored within the energy storage device 128 may not necessarily include electrical energy previously supplied by the generator 112 and/or the first electric motor 122. The fourth operation mode is suitable immediately after the load segment, immediately after the dump segment, or any other instance during which the bowl assembly 130 should be raised.

Figure 4:
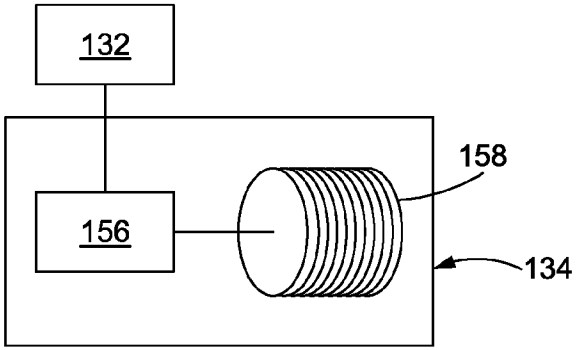
FIG. 4 is a diagrammatic illustration of one exemplary kinetic flywheel system of the present disclosure.

Turning now to FIG. 4, one exemplary embodiment of a kinetic flywheel system 134 which can be used to conserve and recapture energy is provided. More particularly, the kinetic flywheel system 134 of FIG. 4 is coupled to the bowl system 120 and is configured to generate or accumulate kinetic energy based on the reduction in the gravitational potential energy of the bowl assembly 130 as it is lowered during the third operation mode. The kinetic flywheel system 134 is further configured to reapply the accumulated kinetic energy to the bowl actuator 132 to assist in raising the bowl assembly 130 during the fourth operation mode. As shown, the kinetic flywheel system 134 of FIG. 4 includes a clutch 156 that is mechanically coupled to the bowl actuator 132, and a flywheel 158 that mechanically interfaces with bowl actuator 132 via the clutch 156. More specifically, when the clutch 156 is engaged, a friction fit is formed between the clutch 156 and the flywheel 158, and the flywheel 158 mechanically coupled to the bowl actuator 132. When the clutch 156 is released, the flywheel 158 is free to rotate irrespective of the bowl actuator 132.

During the third operation mode, for instance, when the bowl assembly 130 is lowered, the clutch 156 in FIG. 4 is engaged such that the weight of the bowl assembly 130 and any load therein causes the flywheel 158 to spin and collect kinetic energy. Once the bowl assembly 130 has been completely lowered, the clutch 156 is released to allow the flywheel 158 to continue to spin and to preserve at least some of the rotational kinetic energy. During the fourth operation mode, for instance, when the bowl assembly 130 is raised, the clutch 156 is then engaged again such that the rotational kinetic energy in the flywheel 158 is mechanically communicated to the bowl actuator 132. By capturing and preserving losses in gravitational potential energy in the form of rotational kinetic energy, the kinetic flywheel system 134 is able to assist the bowl actuator 132 as well as the second electric motor 124 in raising the bowl assembly 130 and to help conserve energy.

INDUSTRIAL APPLICABILITY

In general terms, the present disclosure sets forth a hybrid power train system and techniques for controlling same.

Although applicable to any type of work machine, the present disclosure may be particularly applicable to tractor scrapers or related earthmoving machines that may be employed in various industries, such as agricultural industry, construction industry, mining industry, and/or other similar industries. In particular, the present disclosure provides mechanisms that can be integrated into the power train of tractor scrapers and used to conserve as well as recapture energy that would otherwise be wasted. For instance, by providing a continuously variable transmission to drive the wheels of the tractor, the primary power source is able to maintain discrete operating speeds and reduce fuel consumption. Furthermore, the present disclosure employs an electric motor to drive the wheels of the scraper which serve to both assist the tractor wheels during acceleration as well as recapture energy during deceleration or coasting. Still further, by implementing a kinetic flywheel system, the present disclosure captures energy lost while lowering the bowl system and reapplies the energy to assist in raising the bowl system.

Figure 5:
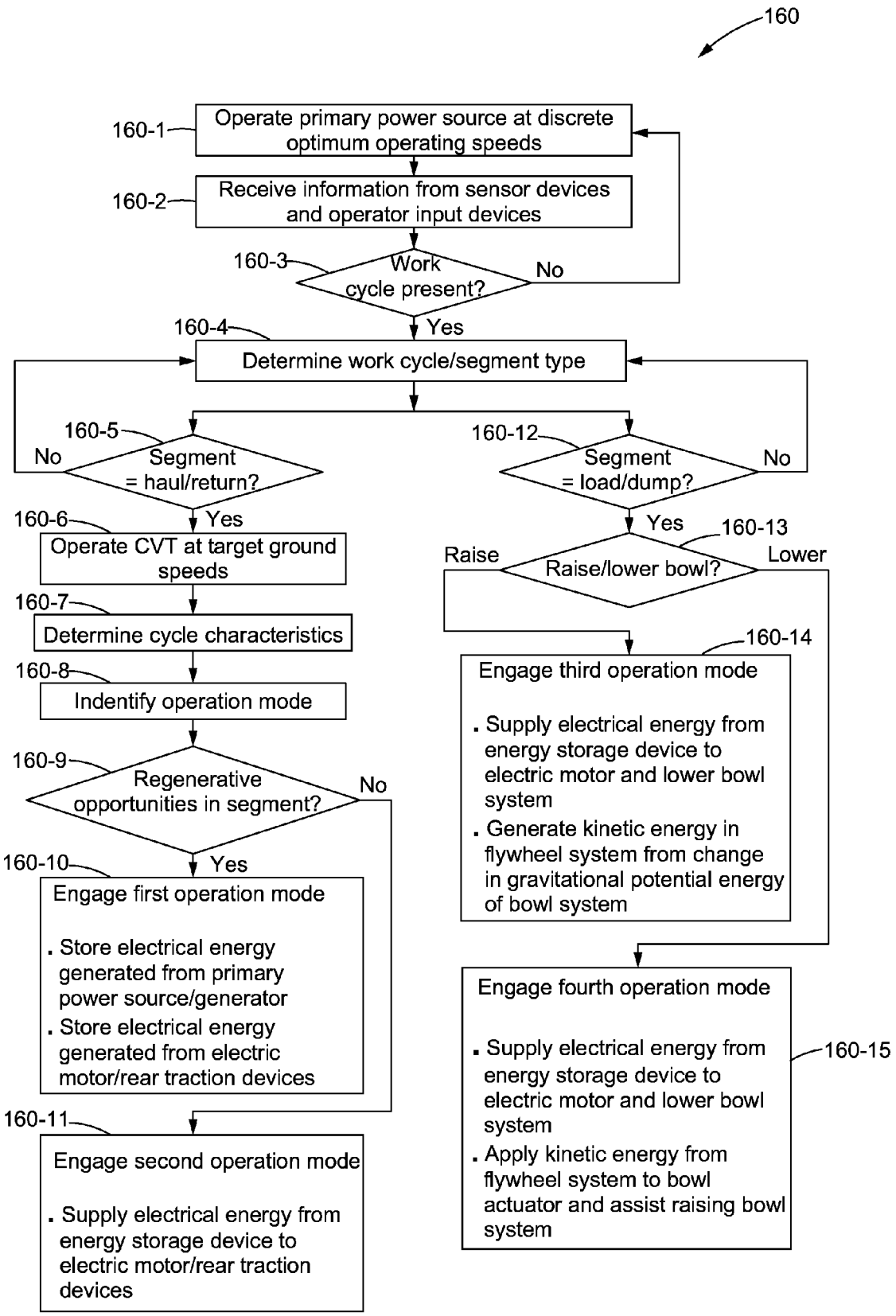
FIG. 5 is a flow diagram of one exemplary method of controlling a hybrid power train system of the present disclosure.

One exemplary method 160 for controlling the hybrid power train system 142 of FIG. 2 is provided in FIG. 5. In particular, the method 160 may be implemented in the form of one or more algorithms, instructions, logic operations, and/or the like, and the individual processes thereof may be performed or initiated by the controller 144 of FIGS. 2 and 3. As shown in block 160-1, the method 160 by default operates the primary power source 110 of the tractor scraper 100 at discrete operating speeds that have been predetermined as being fuel-efficient. For example, the operating speed of the primary power source 110 may be maintained or idling at approximately 1200 RPM, 1400 RPM, 1600 RPM, 1800 RPM, and/or the like, irrespective of the operation or task performed by the tractor scraper 100. Additionally, the method 160, in block 160-2, may include receiving information from one or more sensor devices 146 and one or more operator input devices 148 of the tractor scraper 100. Information received from the one or more sensor devices 146 may include, for example, odometer data, inclinometer data, wheel slip sensor data, payload sensor data, and/or any other information relevant to the tractor scraper 100. Information received from the one or more operator input devices 148 may include steering commands, throttle or speed commands, bowl commands, work tool commands, and/or the like.

Based on the combination of the information received, the method 160, in block 160-3 of FIG. 5, may include determining whether the tractor scraper 100 is operating in a work cycle, such as a reiterative cycle of loading, hauling, dumping and return segments. If the tractor scraper 100 is not operating in such a work cycle, the method 160 continues monitoring for such work cycles while maintaining the primary power source 110 at discrete operating speeds. If, however, the tractor scraper 100 is operating in a work cycle, the method 160 proceeds to block 160-4 to determine the current segment type being performed by the tractor scraper 100 and to control the hybrid power train system 142 in a manner which ensures efficient use of power. For example, if the odometer data, throttle commands, and other information indicate target or actual ground speeds corresponding to speeds typical of a haul or return segment of a work cycle, the method 160 in block 160-5 confirms that a haul or return segment exists, and proceeds to block 160-6 to operate the ECVT 116 and the front traction devices 114 in a manner that substantially matches the target ground speed, or the speed commanded by the operator.

Furthermore, the method 160 in block 160-7 of FIG. 5 determines cycle characteristics within the haul or return segment based on the information received from the one or more sensor devices 146 and the one or more operator input devices 148. Cycle characteristics may include distinct characteristics of the work cycle, for example, the length of the haul or return segment, a grade of the haul or return segment, the length or number of inclines and/or declines in either of the haul or return segment, and the like. Based on the cycle characteristics, the method 160 in block 160-8 may further identify the operation mode to apply. As shown in block 160-9, for example, if the cycle characteristics demonstrate regenerative opportunities within the segment, such as declines or descending paths, and/or the like, the method 160 identifies and engages the first operation mode per block 160-10. During the first operation mode, the method 160 stores electrical energy generated from the primary power source 110 and generator 112, as well as the electrical energy generated from the first electric motor 122 and the rear traction devices 118, into the energy storage device 128.

If, however, the cycle characteristics do not exhibit regenerative opportunities in block 160-9 of FIG. 5, the method 160 identifies and engages the second operation mode per block 160-11. For example, if the cycle characteristics indicate inclines or ascending paths in the given haul or return segment of the tractor scraper 100. In some implementations, the cycle characteristics may indicate entirely inclines or ascending paths. In turn, the method 160 may determine no regenerative opportunities exist and proceed to utilize the energy in the energy storage device 128 to reduce the burden on the primary power source 110, such that the primary power source 110 may keep operating at the discrete speeds which are predetermined according to efficiency. Correspondingly, during the second operation mode, the method 160 in block 160-11 supplies electrical energy from the energy storage device 128 to the first electric motor 122 and the rear traction devices 118. Specifically, electrical energy previously collected by the energy storage device 128, such as during the first operation mode of block 160-10, may be used to drive the rear traction devices 118 to substantially match the target ground speed, or the speed commanded by the operator, and to assist the front traction devices 114. However, it will be understood that electrical energy previously stored within the energy storage device 128 need not necessarily be electrical energy previously supplied by the generator 112 and/or the first electric motor 122.

Referring back to block 160-4 of FIG. 5, if the combination of information received does not correspond to a haul or return segment, the method 160 proceeds to block 160-12 to confirm whether a load or dump segment currently exists. If neither load nor dump segment exists, the method 160 continues monitoring the work cycle and the segment type in block 160-4. If, however, a load or dump segment exists, the method 160 continues to block 160-13 to determine whether a command to raise or lower the bowl assembly 130 is received, such as via one or more of the operator input devices 148. Furthermore, if a command to lower the bowl assembly 130 is received, the method 160 identifies and engages the third operation mode per block 160-14. In the third operation mode, for example, the method 160 supplies electrical energy from the energy storage device 128 to the second electric motor 124 to operate the bowl actuator 132 and to lower the bowl assembly 130. The method 160 in block 160-14 may additionally employ the kinetic flywheel system 134, as shown for example in FIG. 4, to generate and accumulate kinetic energy within the flywheel 158 as the bowl assembly 130 is lowered. Although electrical energy that is supplied by the energy storage device 128 may at least partially include electrical energy previously supplied by the generator 112 and/or the first electric motor 122, it will be understood that electrical energy previously stored within the energy storage device 128 need not necessarily be limited to electrical energy previously supplied by the generator 112 and/or the first electric motor 122.

Alternatively, if a command to raise the bowl assembly 130 is received in block 160-13, the method 160 identifies and engages the fourth operation mode shown in block 160-15. The fourth operation mode may be applicable, for instance, after material at the excavation site has been loaded into the bowl assembly 130 during the load segment, or before leaving the excavation site as in a haul segment. The fourth operation mode may also be applicable after all loaded materials have been dumped from the bowl assembly 130 at the dump site as in a dump segment, and prior to leaving the dump site as in the return segment. During the fourth operation mode, the method 160 supplies electrical energy from the energy storage device 128 to the second electric motor 124 to operate the bowl actuator 132 and raise the bowl assembly 130. Furthermore, the method 160 in block 160-15 may again employ the kinetic flywheel system 134 to apply any kinetic energy previously collected within the flywheel 158 to assist the bowl actuator 132 and the second electric motor 124 in raising the bowl assembly 130. Again, although electrical energy that is supplied by the energy storage device 128 may at least partially include electrical energy previously supplied by the generator 112 and/or the first electric motor 122, it will be understood that electrical energy previously stored within the energy storage device 128 need not necessarily be limited to electrical energy previously supplied by the generator 112 and/or the first electric motor 122.

From the foregoing, it will be appreciated that while only certain embodiments have been set forth for the purposes of illustration, alternatives and modifications will be apparent from the above description to those skilled in the art. These and other alternatives are considered equivalents and within the spirit and scope of this disclosure and the appended claims.

What is claimed is:

1. A hybrid power train system for a tractor scraper, the hybrid power train system comprising:

a primary power source coupled to a first set of traction devices of the tractor scraper;

a generator coupled to the primary power source;

a first electric motor coupled to a second set of traction devices of the tractor scraper;

an inverter circuit coupled to the generator and the first electric motor;

an energy storage device coupled to the inverter circuit; and a controller operatively coupled to the inverter circuit, the controller configured to:

engage a first operation mode for enabling electrical energy, supplied by the generator and the first electric motor, to be stored in the energy storage device, and engage a second operation mode for enabling electrical energy, stored in the energy storage device, to be supplied to the first electric motor to drive the second set of traction devices.

2. The hybrid power train system of claim 1, further comprising a continuously variable transmission coupling the primary power source to the generator and to the first set of traction devices.

3. The hybrid power train system of claim 2, wherein the controller is further operatively coupled to the primary power source and the continuously variable transmission, the controller being configured to:

operate the primary power source at discrete operating speeds while operating the continuously variable transmission to drive the first set of traction devices according to target ground speeds.

4. The hybrid power train system of claim 2, further comprising a first set of transfer gears for mechanically coupling the continuously variable transmission to the first set of traction devices, and a second set of transfer gears for mechanically coupling the first electric motor to the second set of traction devices.

5. The hybrid power train system of claim 1, further comprising a second electric motor coupled to a bowl system of the tractor scraper, the inverter circuit additionally coupling the energy storage device to the second electric motor, the controller configured to:

engage a third operation mode for enabling electrical energy, stored in the energy storage device, to be supplied to the second electric motor and lowering the bowl system, and engage a fourth operation mode for enabling electrical energy, stored in the energy storage device, to be supplied to the second electric motor and raising the bowl system.

6. The hybrid power train system of claim 5, wherein the bowl system includes a bowl assembly, a bowl actuator operatively coupled to the bowl assembly, and a kinetic flywheel system coupled to the bowl actuator, the kinetic flywheel system configured to:

generate kinetic energy based on a change in gravitational potential energy of the bowl system in the third operation mode, and apply the kinetic energy to the bowl actuator to assist in raising the bowl system in the fourth operation mode.

7. The hybrid power train system of claim 1, wherein engaging the second operation mode enables electrical energy, stored in the energy storage device, to be supplied to the first electric motor to drive the second set of traction devices according to target ground speeds.

8. A method of operating a hybrid power train system of a tractor scraper, the method comprising:

determining cycle characteristics of a work cycle of the tractor scraper;

identifying an operation mode of the tractor scraper based on the cycle characteristics and the work cycle;

storing electrical energy, generated through a primary power source and rear traction devices of the tractor scraper, in an energy storage device when a first operation mode for the hybrid power train system is identified; and supplying electrical energy, stored in the energy storage device, to the rear traction devices of the tractor scraper when a second operation mode for the hybrid power train system is identified.

9. The method of claim 8, further comprising:

determining the cycle characteristics and the work cycle based on one or more sensor devices and one or more operator input devices of the tractor scraper, the work cycle including one or more of a load segment, a haul segment, a dump segment, or a return segment, the cycle characteristics including one or more of a length of the haul segment, a grade of the haul segment, or a load growth curve.

10. The method of claim 9, further comprising:

identifying the first operation mode for the hybrid power train system when the cycle characteristics and the work cycle indicate a descending path along one of the haul segment or the return segment of the work cycle; and identifying the second operation mode for the hybrid power train system when the cycle characteristics and the work cycle indicate an ascending path along one of the haul segment or the return segment of the work cycle.

11. The method of claim 8, further comprising:

generating electrical energy through the primary power source and the rear traction devices, using:

a generator mechanically coupled to the primary power source, and a first electric motor mechanically coupled to the rear traction devices in the first operation mode for the hybrid power train system.

12. The method of claim 11, further comprising:

supplying electrical energy to the first electric motor to drive the rear traction devices according to target ground speeds in the second operation mode for the hybrid power train system.

13. The method of claim 8, further comprising:

supplying electrical energy, stored in the energy storage device, to lower a bowl system of the tractor scraper when a third operation mode, for the hybrid power train system, is identified; and supplying electrical energy, stored in the energy storage device, to raise the bowl system when a fourth operation mode, for the hybrid power train system, is identified.

14. The method of claim 13, further comprising:

identifying the third operation mode, for the hybrid power train system, when the cycle characteristics and the work cycle indicate a dump segment; and identifying the fourth operation mode, for the hybrid power train system, when the cycle characteristics and the work cycle indicate a load segment.

15. The method of claim 13, further comprising:

supplying electrical energy to a second electric motor to operate a bowl actuator of the bowl system.

16. The method of claim 13, further comprising:

generating kinetic energy based on a change in gravitational potential energy of the bowl system in the third operation mode for the hybrid power train system; and applying the kinetic energy to a bowl actuator to assist in raising the bowl system in the fourth operation mode for the hybrid power train system.

17. A tractor scraper, comprising:

a tractor including a primary power source, a generator, front traction devices, and a continuously variable transmission coupling the primary power source to the generator and to the front traction devices;

a scraper coupled to the tractor by an articulated joint, the scraper including rear traction devices, a bowl system, a first electric motor coupled to the rear traction devices, a second electric motor coupled to the bowl system, an inverter circuit coupled to the generator, the first electric motor, and the second electric motor, and an energy storage device coupled to the inverter circuit; and a controller operatively coupled to the inverter circuit and configured to:

engage a first operation mode for enabling electrical energy, supplied by the generator and the first electric motor, to be stored in the energy storage device, engage a second operation mode for enabling electrical energy, stored in the energy storage device, to be supplied to the first electric motor to drive the rear traction devices, engage a third operation mode for enabling electrical energy, stored in the energy storage device, to be supplied to the second electric motor and lowering the bowl system, and engage a fourth operation mode for enabling electrical energy, stored in the energy storage device, to be supplied to the second electric motor and raising the bowl system.

18. The tractor scraper of claim 17, wherein the controller is further coupled to the primary power source and the continuously variable transmission, the controller being configured to:

operate the primary power source at discrete operating speeds while operating the continuously variable transmission to drive the front traction devices according to target ground speeds.

19. The tractor scraper of claim 17, wherein the controller is configured to:

enable electrical energy, stored in the energy storage device, to be supplied to the first electric motor to drive the rear traction devices according to target ground speeds in the second operation mode.

20. The tractor scraper of claim 17, wherein the bowl system includes a bowl assembly, a bowl actuator operatively coupled to the bowl assembly, and a kinetic flywheel system coupled to the bowl actuator, the kinetic flywheel system configured to generate kinetic energy based on a change in gravitational potential energy of the bowl system in the third operation mode, and apply the kinetic energy to the bowl actuator to assist in raising the bowl system in the fourth operation mode.

* * * * *